US005682849A

United States Patent [19]

Regueiro

[11] Patent Number: 5,682,849

[45] Date of Patent: Nov. 4, 1997

[54] ROCKER ARM-TAPPET CONNECTOR FOR RADIAL VALVES AND VERTICALLY OPERATING CROSSHEAD

[75] Inventor: Jose F. Regueiro, Rochester Hills, Mich.

[73] Assignee: Chrysler Corporation, Auburn Hills, Mich.

[21] Appl. No.: 726,374

[22] Filed: Oct. 4, 1996

[51] Int. Cl.[6] ..... F01L 1/26; F01L 1/14; F01L 1/18

[52] U.S. Cl. ..... 123/90.22; 123/90.27

[58] Field of Search ..... 123/90.22, 90.27, 123/90.39, 90.4, 90.45, 90.48, 90.52

[56] References Cited

U.S. PATENT DOCUMENTS

| | | | |
|---|---|---|---|
| 5,150,672 | 9/1992 | Fischer et al. | 123/90.27 |
| 5,303,680 | 4/1994 | Nielsen | 123/90.22 |
| 5,347,964 | 9/1994 | Reguiero | 123/90.27 |
| 5,570,665 | 11/1996 | Regueiro | 123/90.27 |

OTHER PUBLICATIONS

SAE Technical Paper Series 960058, "Rotular Tappet* Valve Trains for Hemispherical Combustion Chambers", José F. Regueiro and Vladimir Kosina, Feb. 26–29, 1996.

"Cylinder Head and Valve Train Design for High Power–Density Diesel Engines", Part One, Apr. 21–24, 1996.

*Primary Examiner*—Weilun Lo
*Attorney, Agent, or Firm*—Kenneth H. MacLean

[57] ABSTRACT

A valve train mechanism for an internal combustion engine in which each cylinder of the engine has a pair of angulated exhaust valves and a pair of angulated intake valves and in which a crosshead is operated by a rocker arm for actuating a pair of same function valves through spherical connections below a pair inverted bucket tappets that are located in a pair of tappet guides for movement along a pair of axes which are inclined towards each other and which lie in a plane extending normal to the rotational axis of the crankshaft of the engine.

12 Claims, 7 Drawing Sheets

ROCKER ARM-TAPPET CONNECTOR FOR RADIAL VALVES AND VERTICALLY OPERATING CROSSHEAD

FIELD OF THE INVENTION

This invention concerns internal combustion engines and, more particularly, relates to a valve train mechanism for opening and closing the cylinders of the engine using radially disposed intake and exhaust valves and in which the rocker arms are operated by a single camshaft and serve to actuate inverted bucket tappets through a crosshead.

BACKGROUND OF THE INVENTION

An internal combustion engine using four radially disposed valves for each cylinder provides a number of advantages sought by engine designers. Some advantages that are realized through the use of this type of valve arrangement when combined with a hemispherical combustion chamber are (1) larger valves, (2) improved porting, (3) additional room in the center of the cylinder head for a spark plug, fuel injector, or precombustion chamber, and (4) a cylinder head with large, strong water-jacket cores which provide superior cooling to the combustion-initiation device, valves, valve guides, valve seats and valve bridges. As to the last mentioned advantage, it can be said that the cooling of the cylinder head is realized where it counts while the heat losses from the cylinder head through undesired deck surfaces is reduced because the larger total valve areas occupy a larger proportion of the cylinder head deck than occurs in the case of more conventional cylinder head designs. My SAE technical paper Series 960058 entitled "ROTULAR TAPPET VALVE TRAINS FOR HEMISPHERICAL COMBUSTION CHAMBER" presented to the 1996 SAE International Congress & Exposition in Detroit Mich. in February 1996 as well as my technical paper entitled "CYLINDER HEAD AND VALVE TRAIN DESIGN FOR HIGH POWER-DENSITY DIESEL ENGINES" presented at the 1996 Spring Conference of The American Society of Mechanical Engineers at Youngstown, Ohio in April 1996 provide a further explanation of these advantages.

As explained in the technical papers mentioned above, only about six radial valve designs have been successfully used throughout the history of the internal combustion engine. It is my view that the reason such a small number of radial valve designs have been used heretofore is because the mechanisms required have been complex, large, heavy, and expensive. As a result, their use has been limited to single-cylinder engines such as found in expensive racing motorcycles. Even with the thermodynamic advantages which could be realized by the use of radial valves so as to achieve an increase in engine speed and power, it seems that the size, weight, inertia, friction and lack of stiffness of the various valve train mechanisms incorporating radial valves are factors which have discouraged their use to the extent that the designs never became popular for multi-cylinder internal combustion engines.

My co-pending patent application U.S. Ser. No. 416,245, entitled "Valve Train For Internal Combustion Engine" and filed on Apr. 4, 1995, discloses a very simple type of mechanism that can achieve all the thermodynamic advantages provided by the use of radial valves while using a simple mechanical design. The mechanism consists of a modified inverted bucket tappet with a spherical joint inside so as to allow the valves to be operated in the radial plane while the tappets operate only on the transversal plane of the engine. This mechanism is particularly useful with either a single overhead camshaft (SOHC) engine or a double overhead camshaft (DOHC) engine.

Other mechanisms using conventional inverted bucket tappets with the spherical joint above the tappet have been designed by me and can be seen in my copending patent application U.S. Ser. No. 629,161, entitled "Valve Train For An Internal Combustion Engine", filed on Apr. 8, 1996 and my copending patent application U.S. Ser. No. 08/694,720, entitled "Actuator System For Radial Valves", filed on Aug. 9, 1996. These mechanisms are more suitably adapted to be driven by rocker arms on rocker shafts such as those used with conventional overhead valve designs. The rocker arms can be operated by camshafts mounted in the block using pushrods located therebetween or by camshafts disposed directly on one side of the cylinder head. While the use of spherical joints above the inverted bucket tappet allows the tappet to operate on a plane co-axial to the plane of the valve, it also extends the tappet operational range towards the center of the cylinder.

Except for the largest diesel engines, the encroaching of the tappets around the center of the cylinder limits the space between the four tappets and precludes the use of certain fuel injectors such as the electronically-controlled unit injectors; primarily because they are very large and bulky. With SOHC valve trains such as disclosed in above-mentioned patent application U.S. Ser. No. 08/694,720, the use of three rocker arms and four independent valve actuators obviates the use of electronically-controlled unit injectors on all engines. Similarly, with DOHC valve trains such as disclosed in above-mentioned patent application U.S. Ser. No. 416,245, electronically-controlled unit injectors are not usable with smaller engines because of their size.

With conventional valve train technology where four valves are disposed with their stems in parallel around the center of the cylinder, the smallest engine that, at present, uses the electronically controlled unit injectors and properly sized valves is the Caterpillar (CAT) 3176B truck engine. The CAT engine is an engine of 1.7 liter per cylinder with 125 mm bore diameters, and uses two 45 mm intake valves and two 43 mm exhaust valves for a $\Sigma$ (sum of all the valve diameters divided by the cylinder bore) of 141%. Even though the electronically controlled unit injectors offer superior injection characteristics such as high injection pressures and full electronic timing control while disposing of the long high-pressure fuel lines, this relatively new type of standardized injection system is not presently usable with small engines because it presents three installation problems. One problem in installing the injector body is that it is nearly twice as big as common nozzle holders used with pump-line nozzle systems (P-L-N). Another problem is that the control solenoid, which is 40–42 mm in diameter, extends on a housing parallel to the injector body and is too large to fit between the valve springs and retainers of all present engines smaller than 125 mm bore diameter. The third problem is that the unit injector must be operated by a very large and stiff rocker arm which in most cases is difficult to locate and uses too much space. As a result, the overall worldwide market for this type of injection system is limited, and with low production volumes, the fuel injection manufacturers cannot afford to customize the units to fit a variety of engines.

Accordingly, it is clear that since the electronically controlled unit injectors cannot be used in engines with small cylinder bore diameters and still maintain adequately sized valves, a new cylinder head layout and valve train mechanism is needed that can accommodate such injectors with relatively large sized valves on diesel engines down to about 98 mm cylinder bore diameter, and also down to about 83 mm cylinder bore diameter when a common pump-line nozzle fuel injection system is used. The present invention fulfills this requirement by using certain conventional valve train components in combination with other components some of which are similar to those disclosed in my patent applications mentioned above. I believe that the present invention is also required because in converting older engines from a conventional two or four-valve cylinder head to a new four-valve head with radial valves, one may already have camshafts and other valve train components that may be re-usable.

SUMMARY OF THE INVENTION

In the preferred form, the present invention provides for the use of four valves per cylinder that are radially disposed in the cylinder head of an internal combustion engine. The valves are intended to be driven by a single camshaft which can be mounted either in the cylinder block or on the cylinder head. The camshaft operates a pair of rocker arms and two transversely disposed and vertically movable crossheads, each of which, in turn, actuates a pair of same function valves. Each of the radially disposed valves is operated through an inverted bucket tappet arranged in the transversal plane at the same angle as the associated valve stem. Each tappet is provided with a spherical joint inside the tappet to change the motion from the transversal plane of the tappet to the radial plane of the associated valve. One of the two tappets Of each pair of same-function valves operated by a crosshead is provided with a spherical joint housed on a socket located on the top portion of the tappet. The top portion of the spherical element is formed in the shape of a rectangular key and engages a rectangularly grooved bottom end of the associated crosshead in the transversal plane in a tongue and groove arrangement. During operation, this arrangement compensates for the angularity between the vertically moving crosshead and the tappet moving at an angle to the vertical while allowing for the tongue to slide transversely within the groove. At the same time, the tongue prevents the crosshead when formed as a "T" bridge from rotating about its own axis on its supporting guide pin. The other end of each of the crossheads is provided with a lash adjustment screw combined with a spherical joint which compensates for the angles of motion between the crosshead and the tappet in the transversal plane. This arrangement of the crossheads, tappets and rocker arms provides enough space in the center of the cylinder head and between the valve tappet guides to allow installation of a presently available electronically-controlled unit injector in engines having cylinder bores as small as 98 mm. In addition, this arrangement of components provides a valve train mechanism which could be applicable for engines with cylinder bores as small as 82 mm using common fuel injectors with 17 mm diameter bodies.

Accordingly, one object of the present invention is to provide a new and improved valve train mechanism forming a part of an internal combustion engine having relatively small cylinder bores and in which the components of the valve train mechanism include radial valves operated through spherical joints above and below inverted bucket tappets which are arranged so as to provide sufficient space in the center of the cylinder for a combustion initiation device.

Another object of the present invention is to provide a new and improved valve train mechanism for an internal combustion engine having cylinder bores in the range of 125 mm to 98 mm and in which the valve train mechanism includes inverted bucket tappets located in tappet guides formed in the cylinder head and combined with radial valves in a manner so as to provide sufficient space for an electronically-controlled unit injector between the tappet guides.

A further object of the present invention is to provide a new and improved valve train mechanism including angulated exhaust valves and intake valves incorporated in an internal combustion engine and in which the valve train mechanism includes an inverted bucket tappet for actuating each of the valves and in which a spherical connection is provided between the stem of each valve and the associated inverted bucket tappet and also between the inverted bucket tappet and an arm of a crosshead operatively controlled by a pivoted rocker arm.

A still further object of the present invention is to provide a new and improved valve train mechanism for a multi-cylinder internal combustion engine in which each cylinder of the engine has a pair of angulated exhaust valves and a pair of angulated intake valves and in which a crosshead is operated by a rocker arm for actuating a pair of same function valves through spherical connections below a pair of inverted bucket tappets which are located in a pair of tappet guides for movement along axes which are inclined towards each other and which lie in a plane extending normal to the longitudinal center line of the crankshaft of the engine.

A still further object of the present invention is to provide a new and improved valve train mechanism for an internal combustion engine having at least one cylinder provided with a hemispherical combustion chamber and in which each chamber has a pair of radial exhaust valves and has a pair of radial intake valves and in which each cylinder of the engine has a bore diameter in the range of about 125 mm to about 83 mm and in which the valve train mechanism includes inverted bucket tappets located in tappet guides formed in the cylinder head and combined with radial valves and crossheads in a manner so as to provide sufficient space for a combustion initiation device.

BRIEF DESCRIPTION OF THE DRAWINGS

Other objects, advantages and features of the present invention will be apparent from a reading of the following detailed description when taken with the drawings in which.

DETAILED DESCRIPTION OF THE DRAWINGS

Figure 1:
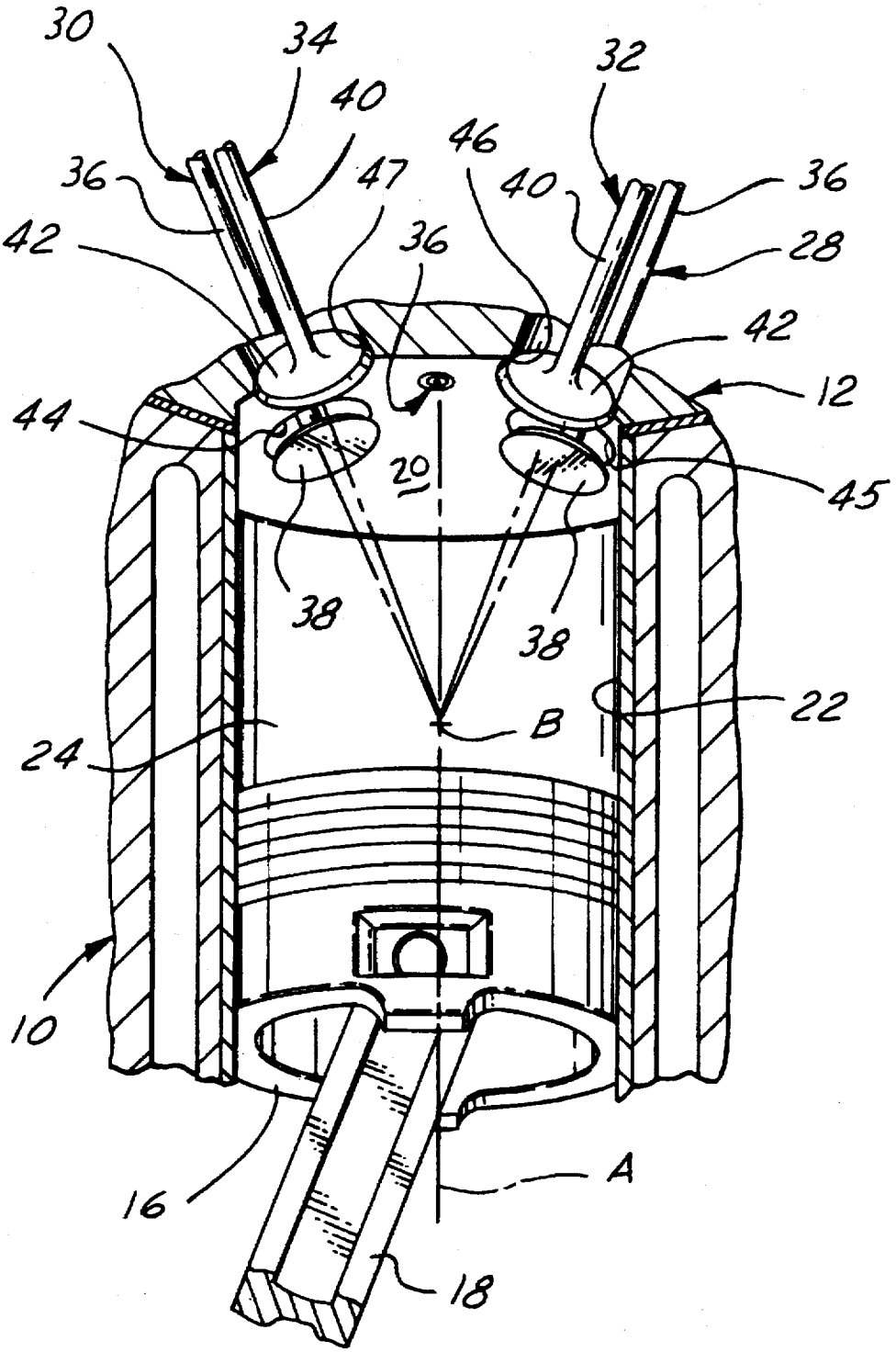
FIG. 1 is a perspective view of one cylinder of a multi-cylinder engine showing a pair of intake valves and a pair of exhaust valves actuated through a valve train mechanism according to the present invention and seen in FIG. 2.

Referring now to the drawings and more particularly to FIG. 1 thereof, a perspective view of a single cylinder of a multi-cylinder engine is shown having an engine block 10 on which is secured by fasteners (not shown) a lower head portion of a two-piece cylinder head assembly 12. The cylinder head assembly 12 serves to support a valve train mechanism 14 in accordance with the present invention and seen in FIG. 2.

Figure 5:
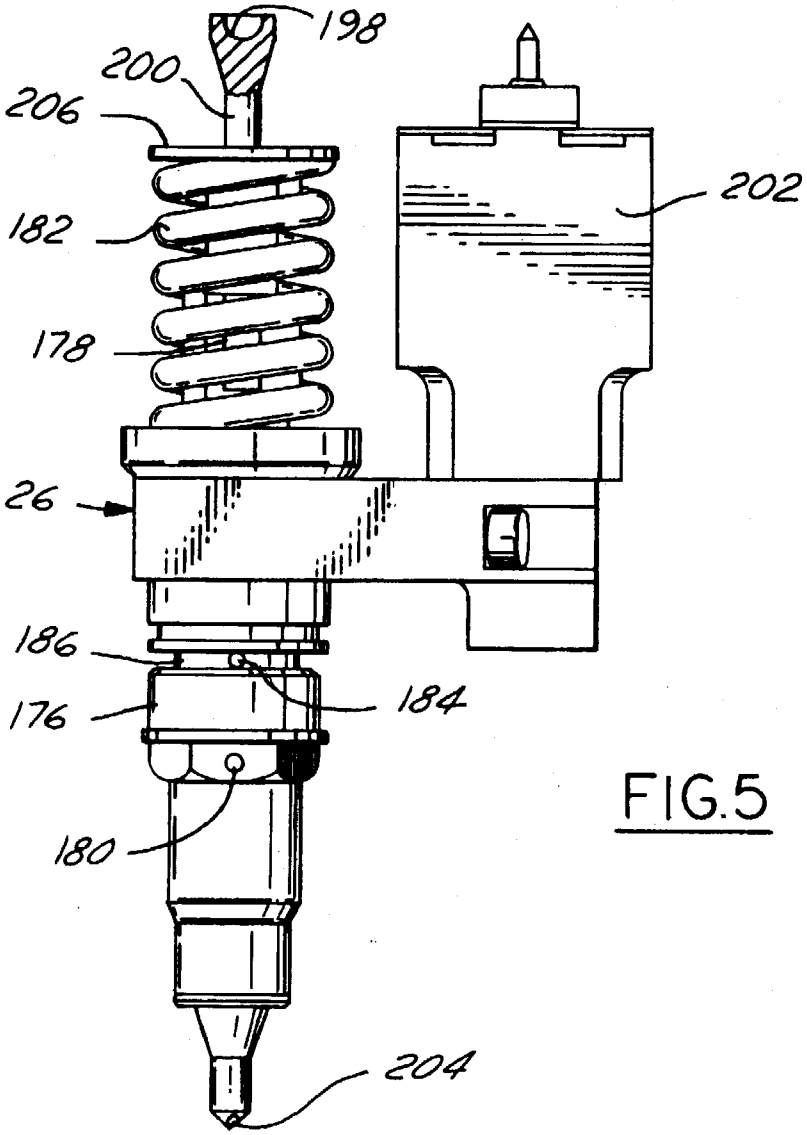
FIG. 5 is an elevational view of an electronically-controlled unit injector of a type incorporated in the valve train mechanism seen in FIGS. 2, 3, and 4.

Each of the cylinders of the engine houses a piston 16 which moves axially along the longitudinal center axis A of the associated cylinder and has the lower end thereof connected to the engine crankshaft (not shown) by a connecting rod 18. The lower base portion 19 of the cylinder head assembly 12 is formed with a hemispherical surface 20 providing a recess which is aligned with the bore defining the associated cylinder 22 and together with the top of the piston 16 forms a combustion chamber 24 which varies in volume during the operation of the engine. In this instance, a lower tip portion of an electronically-controlled unit injector 26 seen in FIG. 5 is secured in the cylinder head 12 centrally of the hemispherical surface or recess 20 along the longitudinal axis "A" of each cylinder 22. The unit injector 26 is secured in position by a clamp and a nut tightened on a stud threadably secured to the lower base portion 19 of the cylinder head 12. As will become apparent as the description of the present invention proceeds, the valve train mechanism 14 according to the present invention can also be used with a pump-line-nozzle fuel (P-L-N) injection system or be incorporated into a spark ignition internal combustion engine in which case a spark plug would be substituted for the unit injector 26.

Figure 2:
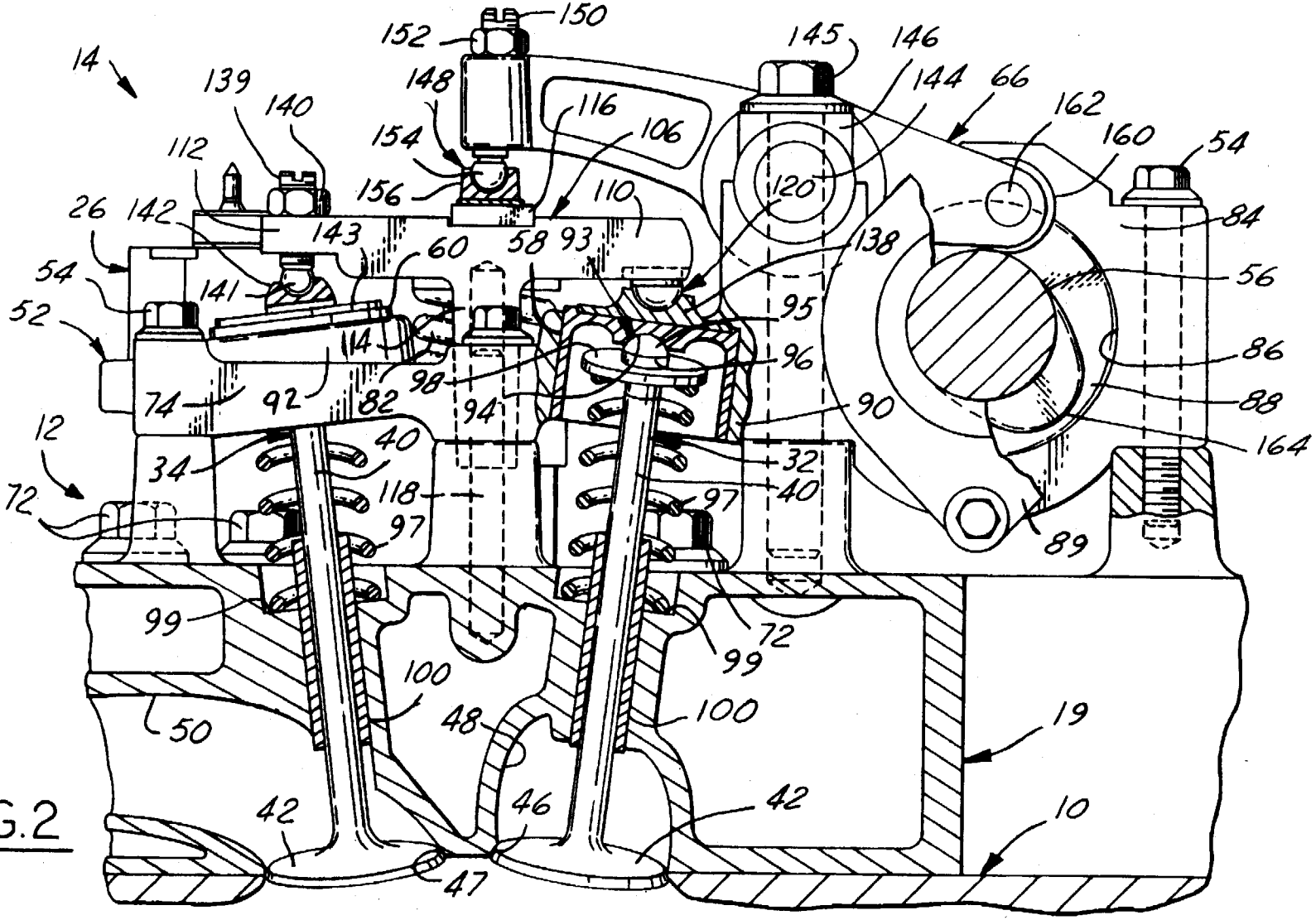
FIG. 2 is a view partially in section of a portion of the cylinder head showing two of the exhaust valves of FIG. 1 and the valve train mechanism for actuating the valves in accordance with the present invention.

As best seen in FIGS. 1, the cylinder head assembly 12 is provided with a pair of intake valves 28 and 30 and a pair of exhaust valves 32 and 34 with each pair of the valves 28, 30 and 32, 34 being located along the transversal plane of the engine. Each of the intake valves 28 and 30 has a valve stem 36 the lower end of which is formed with a round valve head 38. Similarly, each of the exhaust valves 32 and 34 has a valve stem 40 the lower end of which is formed with a round valve head 42. As is conventional, the intake valve heads 38 are normally seated in valve seats formed in the cylinder head that define round openings or ports 44 and 45 of a joint intake passage (not shown) formed in the lower base portion 19 of the cylinder head assembly 12 as seen in FIG. 2. Also, as seen in FIG. 2, the two exhaust valve heads 42 are normally seated in valve seats formed in the cylinder head 12 that define round openings or ports 46 and 47 of exhaust passages 48, 50 also formed in the lower base portion 19 of the cylinder head assembly 12. Although not shown and as is conventional, the exhaust passage 48 sweeps in front of both exhaust valves 32, 34 to join the exhaust passage 50 to exit as a joint passage through an exhaust port window (not shown) to an exhaust manifold.

It will be noted that the valve stems 36 of the intake valves 28 and 30 and the valve stems 40 of the exhaust valves 32 and 34 are disposed radially or angularly about the cylinder head 12 such that the intersection of their longitudinal center axes occurs at a point "B" located on the longitudinal center axis "A" of the cylinder 22 as seen in FIG. 1. As a result, the centers of the valve heads 38 of the intake valves 28 and 30 and the centers of the valve heads 40 of the exhaust valves 32 and 34 are located on a common circle concentric with the periphery of the cylinder 22. In addition, in this case, the centers of the valve heads 38 of the intake valves 28, 30 and the centers of the valve heads 42 of the exhaust valves 32, 34 are circumferentially equally spaced from each other. Also, each of the valve heads 38 and 42 is in an essentially tangential plane relative to the hemispherical recess 20. Thus, as seen in FIG. 1, the longitudinal centerline of each valve 28–34 is canted at an equal angle to both the longitudinal and transversal planes of the engine. This orientation not only allows for more room at the top of the cylinder 22 and lessens the space requirements for valves, spark plugs, injectors, pre-combustion chambers or cooling water jackets, but also produces a far superior combustion chamber with optimum central location of the spark plug or injector. It will be understood that for practical considerations the valves 28-34 may be disposed with different angles on longitudinal and transversal planes so that the point "B" may not fall on the longitudinal center axis "A".

Referring again to FIG. 2, it will be noted that this figure is an elevational sectional view of the cylinder head 12 taken along a plane extending transversely of the engine and shows the two exhaust valves 32, 34 seen in FIG. 1 and the valve train mechanism 14 for actuating the valves in accordance with the present invention. Inasmuch as the engine block 10 and the various operating components normally associated therewith are well known to those skilled in the art of engine design, a detailed showing and/or description of such parts and components is not being provided herein. Instead, the valve train mechanism 14 and the parts associated therewith will be described below in detail. In addition, it will be noted that in describing the structure of the cylinder head assembly 12 and the valve train mechanism 14, only the parts associated with one cylinder of the engine block 10 will be described in detail and it will be understood that similar and identical parts are associated with each of the other cylinders of the engine block 10.

Figure 3:
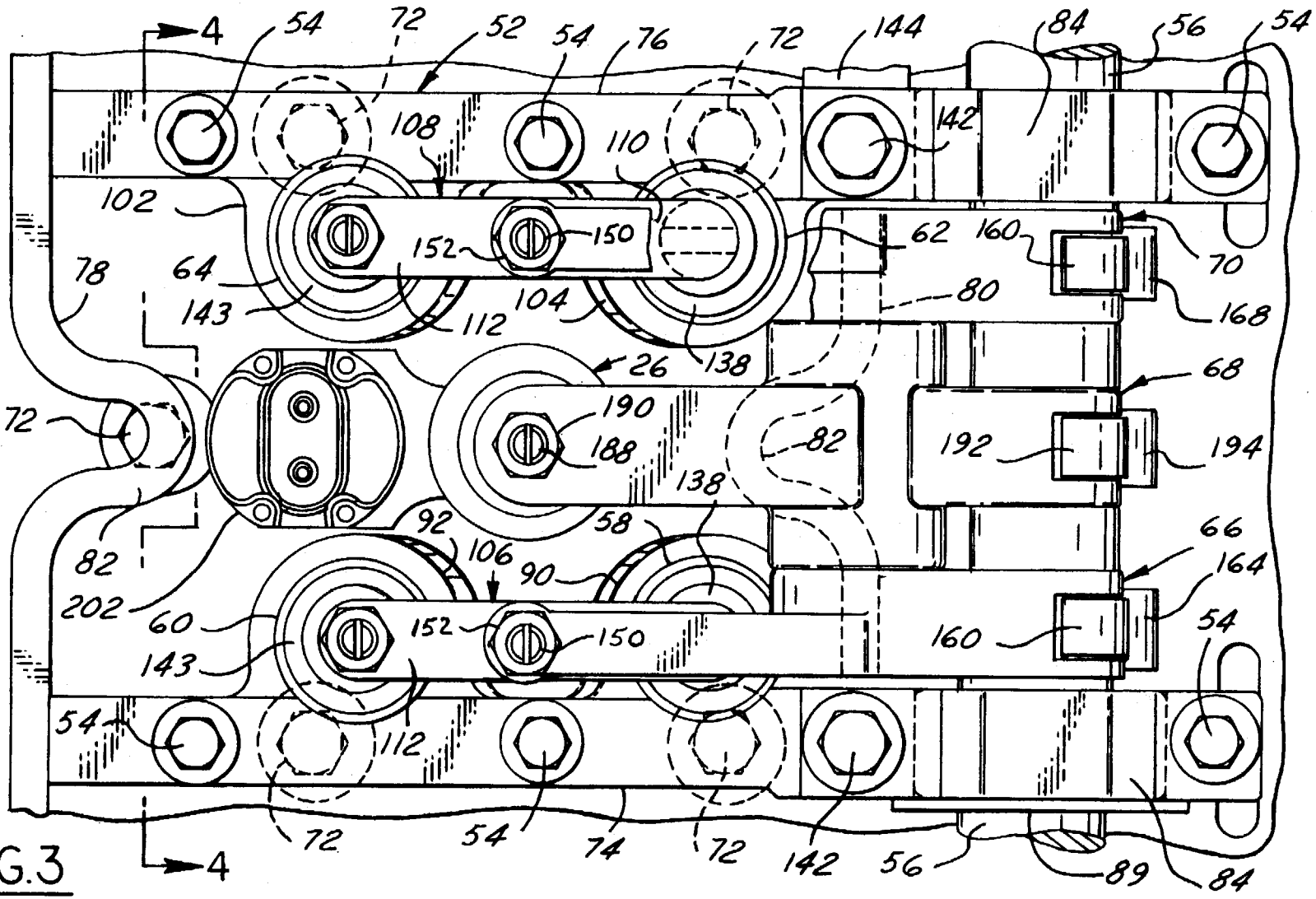
FIG. 3 is a plan view of the valve train mechanism seen in FIG. 2.
Figure 4:
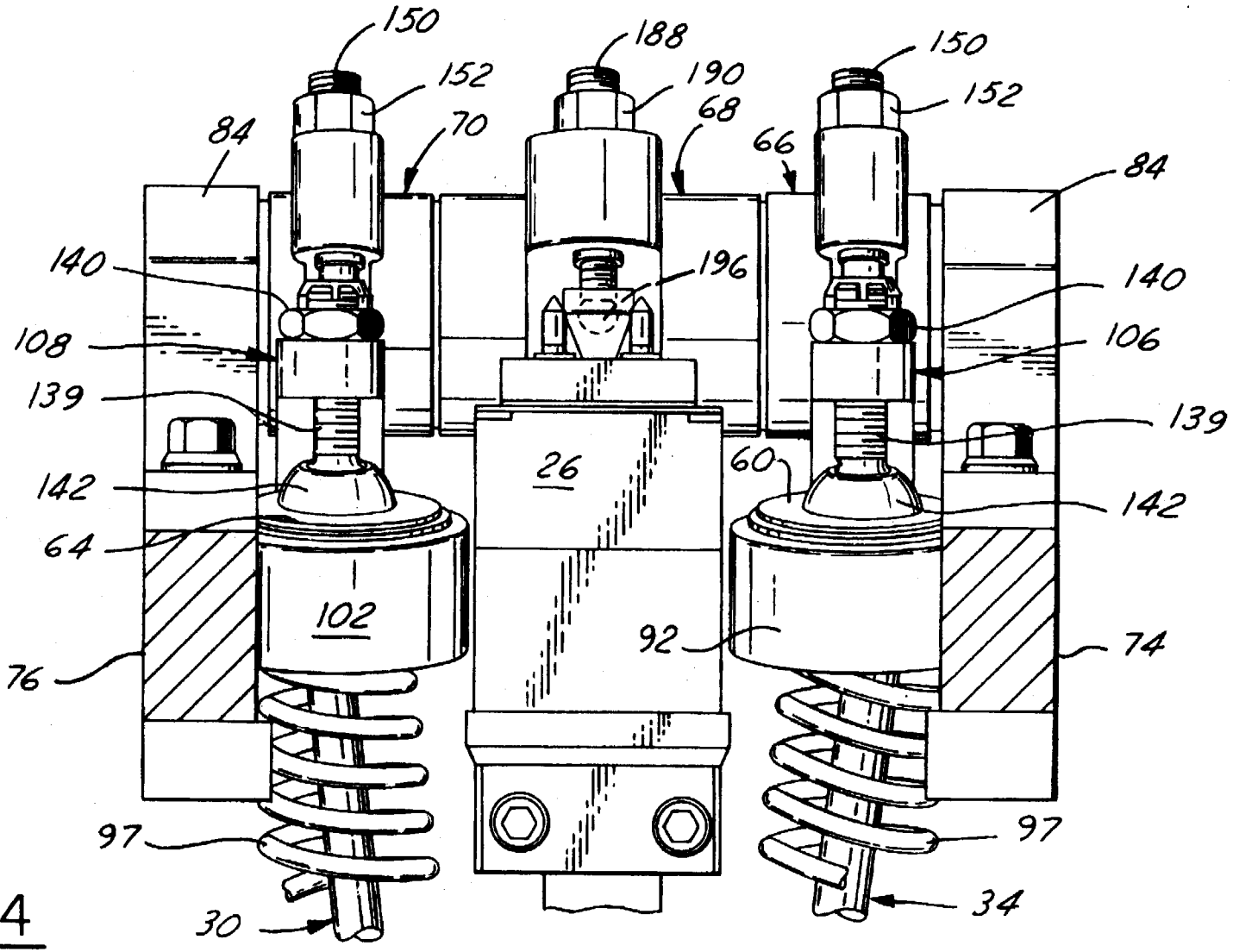
FIG. 4 is a view taken on line 4—4 of FIG. 3.

As seen in FIGS. 2–4, the cylinder head assembly 12 includes the lower base portion 19 which is generally rectilinear and preferably made of cast iron. The cylinder head assembly 12 also includes a carrier 52, preferably made of an aluminum alloy, which is secured to the base portion 19 by a plurality of bolts 54 and serves to support a camshaft 56, inverted bucket tappets 58, 60, 62, 64, and rocker arms 66, 68 and 70 as will be more fully explained hereinafter, for each cylinder. The base portion 19, in turn, is fastened to the upper end of the engine block 10 by a plurality of head bolts 72 which extend through the body of the base portion 19 into threaded holes (not shown) formed in the engine block 10. Although not shown, a pair of laterally spaced and parallel side walls may be integrally formed with the base portion 19 and extend upwardly and, together with a valve cover (not shown) plus corresponding front and back walls, serve to enclose the carrier 52 and the valve train mechanism 14. As seen in FIG. 2, the exhaust passages 48 and 50 are provided in the base portion 19 and communicate with the combustion chamber 24 through the ports 46 and 47.

As best seen in FIGS. 3, the carrier 52 for one cylinder of the engine is formed by fore and aft spaced bulkheads 74 and 76. The bulkheads 74 and 76 are interconnected by a pair of laterally spaced expansion bars 78 and 80 each of which has the midsection thereof formed with a "U" shaped loop portion 82. Each of the bars 78 and 80 are of relatively thin uniform cross section and are designed to flex in a limited region of stress and strain so that they act as an elastic portion of the carrier 52 to compensate for the differential rate of thermal expansion between the aluminum alloy of the carrier 52 and the iron base portion 19 of the cylinder head assembly 12.

As seen in FIGS. 2 and 3, each of the bulkheads 74 and 76 is integrally formed with a ring-shaped bearing portion 84 at one end thereof which is provided with a cylindrical opening 86 in which the journal portion 88 of the camshaft 56 is supported for rotation. The camshaft 56 to be inserted axially into the bearing portions and retained axially by a thrust plate 89 seen in FIG. 2 in combination with the camshaft gear or sprocket (not shown).

The bulkhead 74 is located at the front end of the engine and is integrally formed with a pair of laterally spaced and cylindrically shaped tappet guides 90 and 92. As seen in FIGS. 2, the tappet guide 90 supports the inverted bucket tappet 58 which is in contact with the upper end of the valve stem 40 of the exhaust valve 32 throught a spherical joint 93 of the type seen in my aforementioned U.S. patent application U.S. Ser. No. 416,245. The spherical joint 93, located at the central bottom portion of the associated tappet 58, includes a spherical socket 94 which accommodates a half-ball 95. The flat bottom part 96 of the half-ball 95 abuts the top part of the associated valve stem 40.

Similarly, the tappet-guide 92 supports the inverted bucket tappet 60, which is in contact with the upper end of the valve stem 40 of the exhaust valve 34 through a spherical joint (not shown) which is identical to the spherical joint 93. Each of the exhaust valves 32, 34 is biased into a closed position by a coil compression spring 97 the upper end of which abuts a retainer 94 secured to the valve stem by a conventional two-piece lock. The lower end of each of the springs 97 is located within a spot-faced recess 99 on the top deck of the base portion 19. Each of the valves 32, 34 is supported for reciprocal movement by a valve stem guide 100 mounted in the base portion 19.

As seen in FIGS. 3 and 4, the bulk-head 76 is integrally formed with a tappet guide 102 supporting the inverted bucket tappet 64 associated with the intake valve 30. In addition, a tappet guide 104 integrally formed with the bulkhead 76 supports the inverted bucket tappet 62 associated with the intake valve 28. Similarly, the intake valves 28 and 30 are supported in the base portion 19 by parts corresponding to the parts supporting the exhaust valves 32 and 34 as seen in FIG. 2. Also, although not shown, it will be understood that the upper ends of the valve stems 36 of the intake valves 28 and 30 are connected to the associated inverted bucket tappets through a spherical joint such as the spherical joint 93 seen in FIG. 2. I will also be understood that the bulkhead 76 has tappet guides such as tappet guides 90 and 92 integrally formed on the side opposite the tappet guides 102 and 104 for exhaust valves associated with the cylinder to the rear of cylinder 22. Similar bulkheads with two sets of tappet guides would be provided between the other cylinders and the last bulkhead would be a mirror image of the front bulkhead 74.

At this juncture, it will be noted that as seen in FIG. 4, each of the tappet guides 90, 92 support the inverted bucket tappets 58, 60 associated with the exhaust valves 32, 34 for movement along axes which lie in a vertical plane extending transversely of the engine and which is perpendicular to the rotational axis of the crankshaft of the engine. Similarly, each of the tappet guides 102, 104 support the inverted bucket tappets 62, 64 associated with the intake valves 28, 30 for movement along axes which lie in a vertical plane extending transversely of the engine and which is perpendicular to the rotational axis of the crankshaft of the engine. However, as seen in the FIG. 2, the tappet guides 90, 92 also support the inverted bucket tappets 58, 60 associated with the exhaust valves 32, 34 and the intake valves 28, 30 so that they move along axes which are inclined towards each other and are in line with the longitudinal center axis of the associated valve stem when viewed in transverse cross section.

As seen in FIGS. 1–5, opening of the exhaust valves 32, 34 and the intake valves 28, 30 against the bias of the associated springs 97 is controlled through the valve train mechanism 14 which in this case, as shown, includes two identical crossheads or "T" bridges 106 and 108 each of which comprises two outwardly extending arm portions 110 and 112 integrally formed with a leg portion 114. The leg portion 114 of each of the "T" bridges 106, 108 is provided with a flat top plate 116 and is supported for reciprocal movement by a guide pin 118 the lower end of which is fixed to the top deck of the base portion 19. The longitudinal center axis of each guide pin 118 is positioned parallel to the axis "A" of the cylinder 22.

Figure 6:
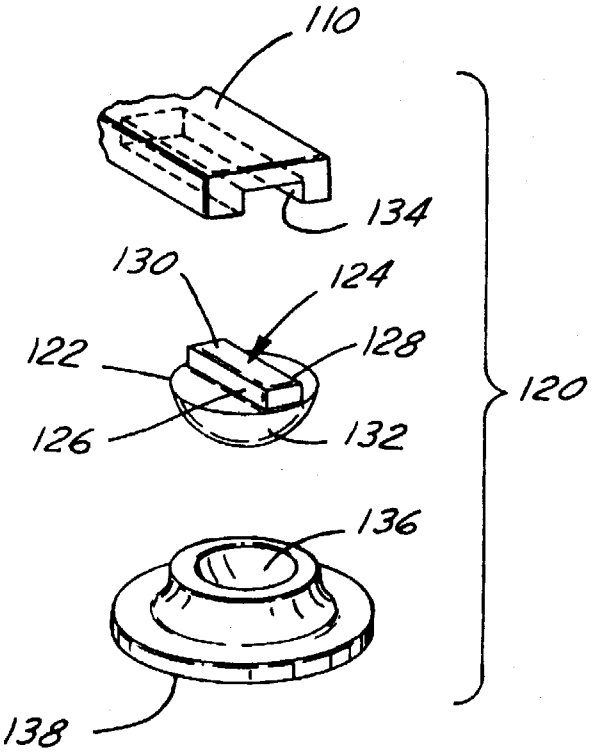
FIG. 6 is an exploded view of one arm of the "T" bridge seen in FIG. 2 and the associated inverted bucket tappet.

The arm portion 110 of each "T" bridge 106, 108 is provided with a combination spherical and sliding joint 120. Thus, as seen in FIGS. 2, 3 and 6, a combination spherical and sliding joint 120 is positioned between the arm 110 of the "T" bridge 106 and the inverted bucket tappet 58 and the arm 110 between the "T" bridge 108 and inverted bucket tappet 62. As seen in FIGS. 2 and 6, the combination spherical and sliding joint 120, in each instance, is the same in construction and includes a half-ball member 122 having an integral upwardly extending tongue 124 defined by a pair of spaced flat and parallel side walls 126 and 128 and a flat top wall 130 which is located in a plane normal to the associated side walls 126 and 128. The half-ball member 122 also includes a spherical lower surface 132. The top portion of the tongue 124 of the half-ball member 122 is slidably received by a slot 134 formed in the head end of the arm portion 110. The slot 134 corresponds to the shape of the torque 124 and is "U" shaped, of uniform cross section, and extends along the longitudinal axis of the associated arm portion. The lower spherical surface 132 of the half-ball member 122 is located within a spherical recess 136 centrally formed in a socket member or shim 138 which is formed as a separate disc member centrally positioned within a circular recess in the top of the associated inverted bucket tappet. As an alternative, the socket member 138 can be made integral with the top of the associated inverted bucket tappet.

The opposite arm portion 112 of each "T" bridge 106, 108 carries a conventional lash adjustment screw 139 threaded therein and secured thereto by a locknut 140. The screw has its lower end integrally formed with a ball 141 located in a socket member 142 to form a spherical joint which is frequently referred to as an "elephant's foot".

The flat bottom of the socket member 142 abuts the flat upper surface of a hardened shim 143 located in a circular recess formed in the top portion of the associated inverted bucket tappet. The socket member 142 is therefore able to slide freely on the shim 143 during operation of the valve train mechanism 14.

The "T" bridges 106 and 108 are respectively operated by the rocker arms 66 and 70 which are supported for oscillation by a rocker arm shaft 144 secured to one shoulder of the bearing portion 84 of each of the bulkheads 74 and 76 by a bolt 145 which extends through a cap 146, through the corresponding holes in each of the bulkheads 74, 76 and through the rocker arm shaft 144 into a threaded opening (not shown) in the base portion 19. The rocker arms 66 and 70 are mirror images of each other with the tail end portion of each being provided with a spherical joint 148 of the type provided on the arm portion 112 of each "T" bridge 106, 108. Each of the spherical joints 148 includes an adjusting screw 150 the shank portion of which is threaded into the tail end of the associated rocker arm and is secured thereto by a locknut 152. The lower end of the adjusting screw 150 is integrally formed with a ball portion 154 captured within a spherical recess of a socket member 156 having a flat lower contact surface in relative slidable engagement with the center flat top plate 116 of the associated "T" bridge. As with the spherical joint on the arm portion 112 of each "T" bridge 106, 108, the screw 150 serves to individually set the lash adjustment for each valve system.

The head-end portion of each rocker arm 66 and 70 is provided with a roller 160 supported for rotation by a shaft 162 fixed to the associated rocker arm. As seen in FIGS. 2 and 3, the rollers 160 of the rocker arms 66 and 70 are in rolling contact with cam lobes 164 and 168, respectively, formed on the overhead camshaft 56. Both the camshaft 56 and the rollers 160 are each supported for rotation about an axis which is substantially parallel to the rotational axis of the engine crankshaft. Also, the longitudinal center axis of the rocker shaft 144 about which the rocker arms 66, 68 and 70 oscillate is parallel to the rotational axes of the rollers 160 and the camshaft 56.

It will be noted that each of the guide pins 118 associated with the "T" bridges 106 and 108 is located so as to realize an efficient operation of the valve train mechanism 14 and provide sufficient space for the fuel injector or prechamber in the case of a compression ignition engine and for the spark plug in the case of a spark ignition engine. In this regard, it will be noted that the longitudinal center axis of each guide pin 118 as well as the longitudinal center axis of the joined arm portions 110 and 112 of each "T" bridge 106, 108, as seen in FIG. 4, are located in the aforementioned transverse plane in which the axes along which the associated inverted bucket tappets are movable.

Accordingly, with the "T" bridges 106, 108 being positioned as described above and as the camshaft 56 rotates in timed sequence to the associated engine crankshaft, the tail end of the rocker arms 66 and 70 will be pivoted downwardly as seen in FIG. 2 when the rollers 160 are contacted by the lift portions of the cam lobes 164 and 168 to open the exhaust valves 32 and 34 and provide communication between the combustion chamber 24 and the exhaust passages 48 and 50 and also open the intake valves 28 and 30 to provide communication between the intake manifold through the intake passages to the combustion chamber 24. Inasmuch the tail end of each of the rocker arms 66 and 70 moves along an arc while each of the associated "T" bridges 106, 108 (under the urging of the rocker arms 66 and 70) moves downwardly along the longitudinal center axis of guide pin 118, the socket member 156 of the spherical joint 148 of each rocker arm 66 and 70 will slide in the transversal plane relative to the associated "T" bridge. At the same time, as the "T" bridges 106, 108 are moved downwardly by the rocker arms 66 and 70, the combination spherical joint and sliding connections between the arm portions 110 and 112 of each of the "T" bridges 106, 108 and the associated inverted bucket tappets serve to compensate for the different movement of the inverted bucket tappets as seen in FIG. 2. Thus, during this movement, the socket member 142 of each spherical joint at the arm portion 112 slides along the associated shim 143 while the tongue 124 of the spherical joint 120 slides relative to the slot 134 in the arm portion 110. At the same time, the tongue and groove connection provided by the spherical joint 120, prevents the associated "T" bridge from rotating about the longitudinal center axis of the guide pin 118.

As to the movement of the exhaust valves 32 and 34 and the intake valves 28 and 30 towards point "B" as seen in FIG. 1 while the associated inverted bucket tappet experiences only an angled movement in the transversal plane, the spherical joint 93 provided between the under side of each inverted bucket tappet 58–64 and the upper end of the associated valve stem serve to compensate for the compound angled movement of the valves 28–34. Also, the flat bottom surface 96 of each half ball 95 abutting the flat type of associated valve stem slides with respect to the longitudinal plane.

Figure 8:
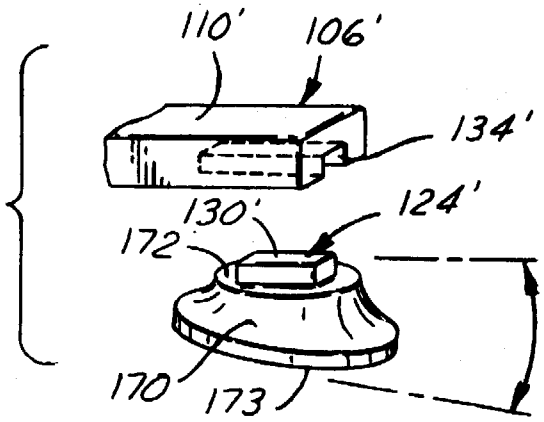
FIG. 8 is an exploded view of the connection seen in FIG. 7.
Figure 7:
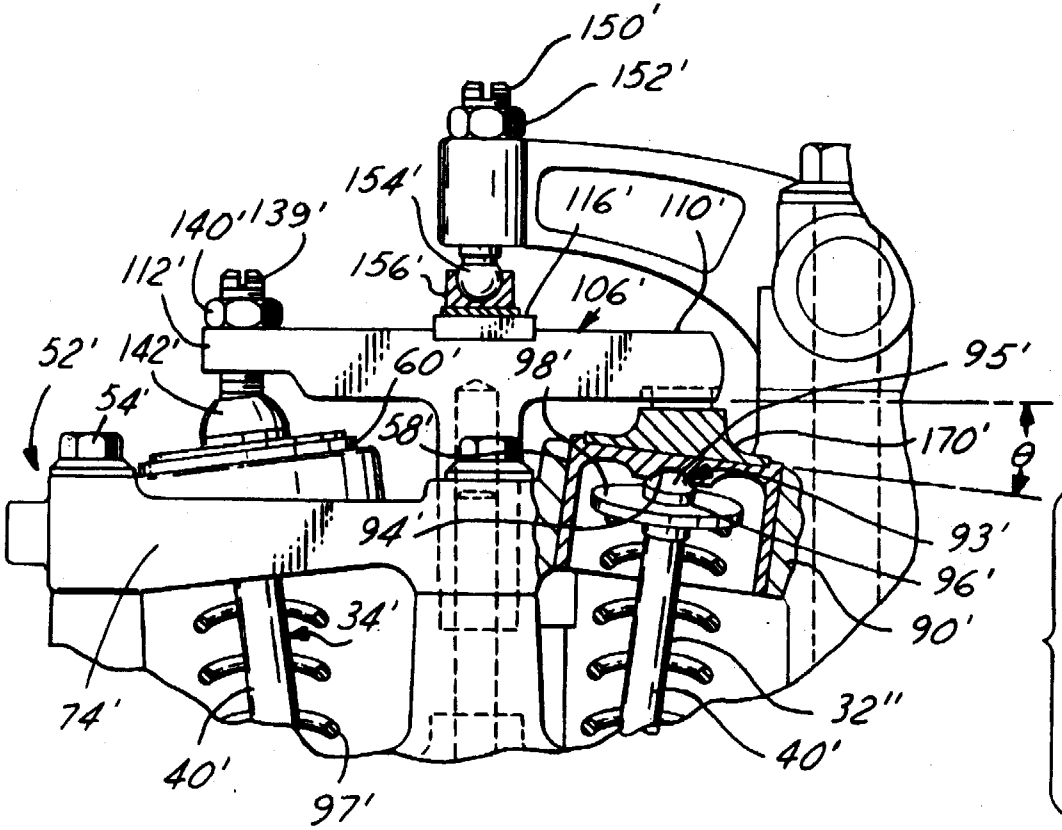
FIG. 7 is an elevational view showing a modified form of the connection between one arm of a "T" bridge seen in FIG. 2 and the associated inverted bucket tappet.

FIGS. 7 and 8 show a modified version of the connection between the arm portion 110 of each "T" bridge 106, 108 and the associated inverted bucket tappet. It will be noted that parts corresponding identically with the parts of the cylinder head 12 and valve train mechanism 14 seen in FIGS. 2–4 are identified by the same reference numerals but primed.

As seen in FIGS. 7 and 8 the arm portion 110' is formed with a slot 134' which is identical to the slot 134 in the arm portion 110. However, rather than having a socket member carried by the top of the associated inverted bucket tappet 58', the latter is provided with a shim 170 terminating at its upper end with a flat surface 172 which is integrally formed with an up- standing tongue 124'. The tongue 124' is received within the slot 134' for relative sliding movement and is essentially of the same cross-sectional configuration as that of the slot 134'. It will be noted, however that the planes of the top surfaces 172 of the shim as well as 130' of the tongue are parallel to each other but at an angle θ to the plane of the bottom surface 173 of the shim 170; the angle θ being equal to the transversal angle as viewed in FIG. 7 of the longitudinal center axis of valve stem 40' relative to the longitudinal center axis of the guide pin 118'.

Figure 9:
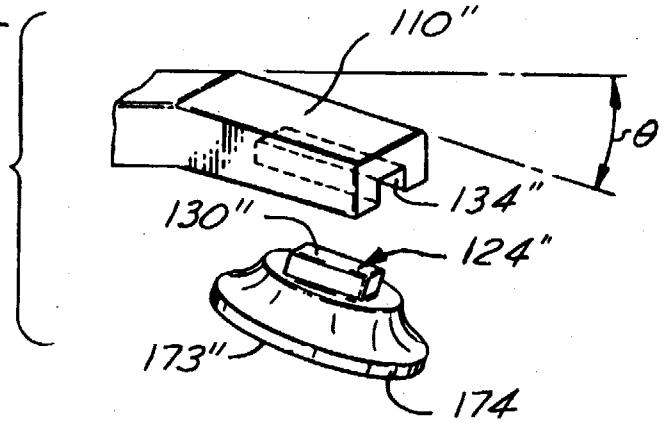
FIG. 9 is an exploded view of a further modified form of the connection between one arm of the "T" bridge seen in FIG. 2 and the associated inverted bucket tappet.

A further modified version of the connection between the one arm portion 110' of the "T" bridge 110' and the associated inverted bucket tappet can be seen in FIG. 9 with those parts corresponding to the parts shown in FIGS. 7 and 8 being identified by the same reference numerals but double primed. In this instance, the top surface 130" of the tongue 124" and the bottom surface 172" of the shim 174 lie in planes which are parallel to each other. However, the end of the arm portion 110" is bent downwardly at an angle θ which, as indicated above, is the same as the transversal angle θ of the valve stem relative to the longitudinal center axis of the guide pin 118' as seen in FIG. 7.

As alluded to hereinbefore, the valve train mechanism 14 described above is intended for use with engines having small cylinder bore diameters while still maintaining adequately sized valves. One particular application of the valve train mechanism 14 is for it to be combined with the electronically-controlled unit injector 26. In other words, this valve train mechanism 14 allows one to have relatively small cylinder bore diameters in the range of about 125 mm to 98 mm and, as seen in FIGS. 2, 3, and 4 still have sufficient space for the electronically controlled unit injector 26 which is shown in elevational view in FIG. 5.

With reference to FIG. 2–5, it will be noted that the unit injector 26 shown is of a typical design such as manufactured by Lucas Industries of Great Britain and identified as Model EUI 100. This unit injector 26 includes a main body 176 having a plunger 178 housed within a bore (not shown) to form a pumping chamber in the main body of the unit injector. Fuel is continually circulated through passages (not shown) in the cylinder head that are in fluid communication with a fuel feed port 180. The fuel flows from the feed port 180 to the pumping chamber during the injection dwell period when the plunger 178 is retracted to its uppermost position by action of a return spring 182. The fuel flows through the pumping chamber and exits through a spill port and passage (not shown) within the control chamber in which a check valve (not shown) is kept open by the action of a spring (not shown) to allow the fuel to recirculate and keep the pumping chamber full of fuel in preparation for the successive injection. The fuel flows out of the body of the unit injector through a fuel return orifice 184 and a fuel return groove 186 which is in fluid communication with a fuel return passage (not shown) formed in the cylinder head. From the fuel return passage, the fuel returns to the fuel tank.

As seen in FIGS. 3 and 4, the rocker arm 68 is mounted on the rocker arm shaft 144 between the rocker arms 66 and 70 and serves to operate the unit injector 26. The tail end of the rocker arm 68 is provided with an adjustment screw 188 which is fixed in position by a locknut 190 while the head end of the rocker arm 68 has a roller 192 which engages a cam 194 on the camshaft 56. The lower end of the adjustment screw 188 is formed with ball 196 which is seated in a spherical recess 198 formed in the top end of a pushrod 200. The pushrod 200, in turn, is connected to the plunger 178 of the unit injector 26.

Thus, at the desired moment of injection as dictated by the position of the cam 194, the rocker arm 68 pivots about the rocker arm shaft 144 causing the tail end of the rocker arm 68 to move downwardly as seen in FIG. 4. At the same time the split port in the injector 26 is closed by the lower surface of the moving plunger. The plunger in the pumping chamber begins displacing fuel through the control valve. At the desired movement to begin injection, the control valve is closed by the action of a solenoid 202 attached to the main body 176 of the unit injector 26. This then initiates a fast pressurization process as the plunger 178 continues moving downwardly. As the pressure reaches the pe-set opening level of the injector needle (not shown), the injector needle lifts and the injection period begins. Since at the beginning of injection the entire pumping chamber is filled with more fuel than would be required by even the largest injection quantity for the particular engine application, fuel keeps being pressurized by the plunger 178 and injected through the nozzle discharge orifices 204 until enough fuel has been injected to satisfy the operational load and speed requirements of the engine at the particular moment. Thus, when the desired amount of fuel is injected, with the quantity determined electronically by the action of a computer (not shown), the solenoid 202 is de-energized and the pressurized fuel quickly spills through the control valve and port 184. Further movement of the plunger 178 creates additional displacement of fuel, which is dumped also through the port 184 and groove 186 back to the fuel return passage formed in the cylinder head and then to the fuel tank. When the cam lobe 194 on the camshaft 56 moves over its nose (maximum point from the center of the center of the camshaft) and the plunger 178 reaches its point of maximum travel, continued rotation of the cam lobe 194 causes the plunger 178, retainer 206, push rod 200, and rocker arm 68 (urged by the return spring 182) to follow the profile of the cam lobe 194. As the upward return motion of the plunger 178 uncovers the fuel feed port 180, fuel again is able to begin refilling the pumping chamber. During this period and after the roller 192 of the rocker arm 68 is seated on the base circle of the cam lobe 194, the solenoid 202 is de-energized, fresh fuel flows through the pumping chamber, control valve and port 184, to complete the chamber filling process.

The unit injector 26 is able to generate very high pressures which are over 25,000 psi, provide programmable electronic control of the beginning and the end of the injection process at the most optimum timing of combustion, eliminate the use of high pressure lines, provide almost immediate fluid response to the action of the solenoid 202, and provide for ruggedness and simplicity of installation. As a result, unit injectors would seem to be the preferred choice for use in diesel engines. However, until now their size has prevented their application for diesel engines having cylinder bore diameters less than 125 mm. FIGS. 2–5 show how the valve train mechanism allows the installation of this type of injection system even on some of smallest engines of the "300 Series" (engines of one liter per cylinder). In larger bore engines provided with conventional valve train technology, the main body 176 of the unit injector 26 has sufficient room to fit in the center of the cylinder. However, that is not the case with the smaller engines. Moreover, even with some of the larger engines in which available space is not a problem for the main body of a unit injector, fitting the solenoid 202 between any two of the valves is, in many cases, possible only by a major reduction of the valve sizes. Accomplishing an acceptable installation within the confines of smaller engines and allowing larger valves or improved injector cooling on larger engines, however, is possible with the valve train mechanism 14 described above.

One further advantage of the valve train mechanism 14 according to the present invention is that it can also be used with engines having cylinder bores as small as about 82–83 mm when combined with common P-L-N injector system having 17 mm diameter injector bodies. In addition, the valve train mechanism 14 could be used in spark ignition internal combustion engines having a spark plug rather than a fuel injector as the combustion initiation device. The valve train mechanism 14 can also be used on indirect injection engines needing space for a prechamber located over the center of the cylinder.

Figure 10:
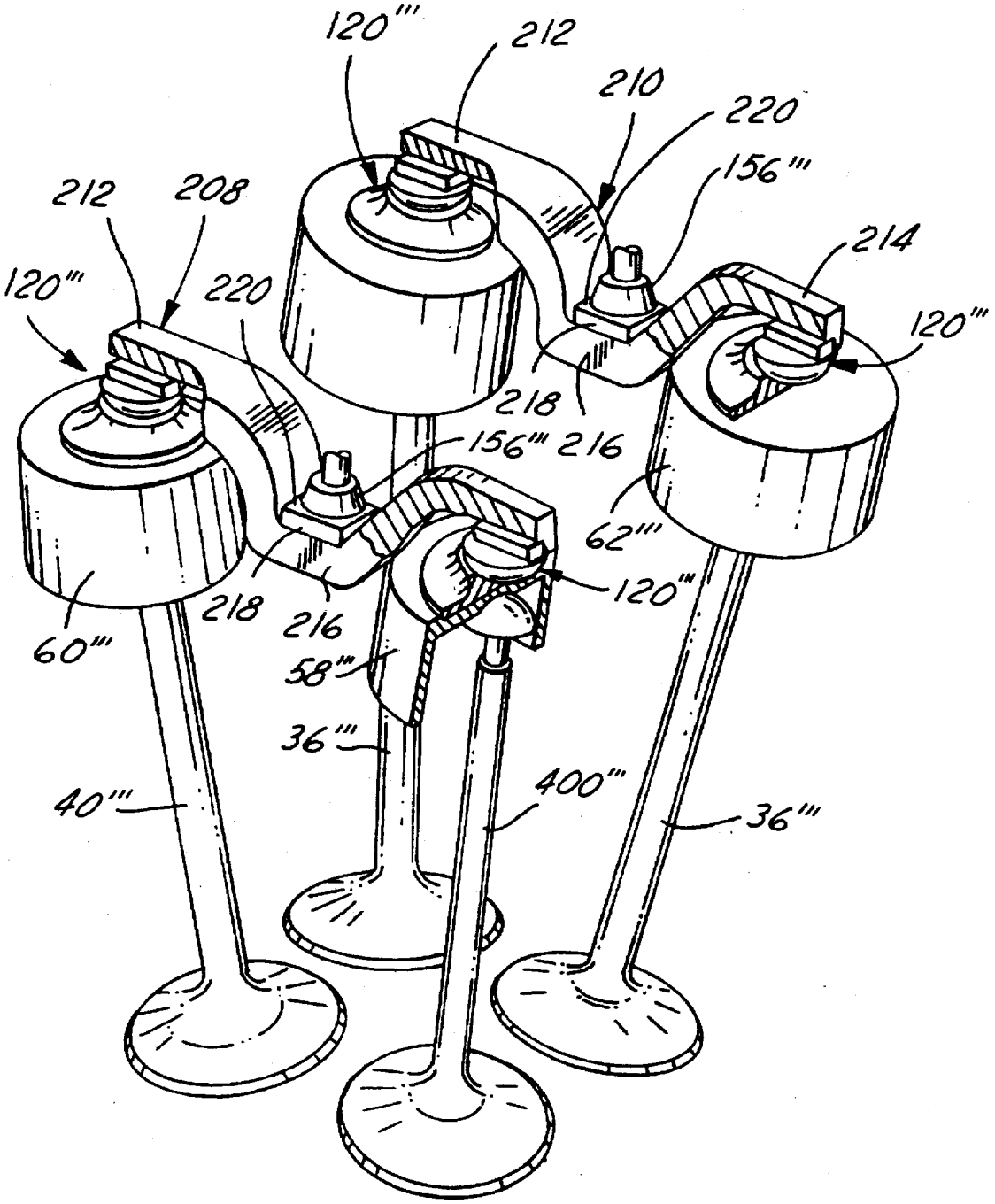
FIG. 10 is a perspective view showing only the valves, tappets and certain revised parts of a modified form of the valve train mechanism seen in FIGS. 1–4.

FIG. 10 is a perspective view showing the use of a pair of unguided cross members or crossheads with the valve train mechanism 14 of FIGS. 1–4 rather than using the "T" bridges. Thus, it will be understood that the only change in parts from the valve train mechanism 14 seen in FIGS. 1–4 is the substitution for the "T" bridges of a pair of identical unguided cross members 208 and 210 each of which is provided with a combination spherical and sliding joint at each end of the cross member. Accordingly, those parts shown in FIG. 10 that are identical to the parts of the valve train mechanism 14 seen in FIGS. 1–4 are identified by corresponding reference numerals but triple primed.

Referring to FIG. 10, in this instance it should be apparent that the major difference lies in the fact that the cross members 208 and 210 are not guided by a pin or other structural member during operation of the valve train mechanism. In order to properly locate the cross members 208 and 210 and prevent them from disengaging the top of the associated inverted bucket tappets 58''', 60''', 64''', each end arm 212 and 214 of each cross member 208 and 210 is formed with a combination spherical and sliding connection 120'''which is structurally and functionally the same as provided on the arm 110 of the valve train mechanism seen in FIG. 2. Thus, each arm 214 of the cross members 208, 210 has a half-ball 122'''provided with an upwardly extending tongue 124'"which fits within a rectangular groove or slot 134'"in the arm of the associated crosshead. A similar arrangement of a half-ball tongue and groove is provided at the other arm 212 of each of the cross members 208, 210. Moreover, the center 216 of each cross member 208, 210 is designed so as to carry a wear pad 218 having a flat upper surface 220 upon which rests the socket member forming a part of the "elephant foot" connected to the tail end of the associated rocker arm. In order to assure stability during operation of the mechanism, it will be noted that each cross member 208, 210 must have the point of contact between the associated wear pad and the bottom of the associated elephant's foot located below a line joining the centers of the two half-balls 122'"forming a part of each cross member.

Various changes and modifications can be made to the above-described valve train mechanism without departing from the spirit of the invention. Accordingly, such changes and modifications are contemplated by the inventor and he does not wish to be limited except by the scope of the appended claims.

The embodiments of the invention in which an exclusive property or privilege is claimed are defined as follows:

1. A valve train mechanism for opening and closing the cylinders of an internal combustion engine having an engine block with one or more cylinders therein and a piston operatively disposed in each of the cylinders to define one end portion of a respective combustion chamber therein, a cylinder head operatively disposed on said engine block and having a recess therein aligned with said cylinder to define a respective second end portion of said combustion chamber, first and second air intake valves and first and second exhaust valves, valve seats for each of said valves, each of said valves having an enlarged head portion for operative engagement with an associated one of said valve seats and having an elongated stem portion extending from said head portion through a stem opening in said cylinder head, each of said stem portions defining an axis and each being inclined so as to diverge away from the axis of any other of said stem portions, an inverted bucket tappet for each of said valves, a swivel joint provided between each of the inverted bucket tappets and the top of the associated stem portion, a cross head having a pair of opposed arms disposed to contact the top portions of a pair of inverted bucket tappets of a pair of same function valves, said cylinder head being formed with a tappet guide for each of said pair of inverted bucket tappets, the tappet guides for each of said pair of inverted bucket tappets of said pair of same function valves being positioned so as to cause said each of said pair of inverted bucket tappets to move along axes which are inclined towards each other and which lie in a plane extending normal to the rotational center axis of the crankshaft of the engine, said cross head being disposed to move in a plane essentially transversal to said rotational center axes of said crankshaft of said engine, one of said arms of said crosshead contacting said top portion of one of said pair of inverted bucket tappets through a first spherical joint, the other of said arms of said crosshead including a tongue and groove connection for contacting the other of said pair of inverted bucket tappets, a rocker arm pivoted on a rocker shaft and having one end thereof engaging the center of said crosshead through a second spherical joint, and a camshaft operatively connected to the other end of said rocker arm, the arrangement of said intake valves, said exhaust valves, said inverted bucket tappets, said spherical joints, and said crosshead being such that sufficient space is provided in the cylinder head to accommodate a combustion initiation device centrally of said valves.

2. The valve train mechanism of claim 1 wherein said combustion initiation device is an electronically-controlled unit injector.

3. The valve train mechanism of claim 2 wherein a separate rocker arm is provided on said rocker shaft for actuating said electronically-controlled unit injector.

4. The valve train mechanism of claim 1 wherein each of said cylinders has a bore diameter in the range of about 125 mm to about 82 mm.

5. The valve train mechanism of claim 1 wherein said tongue and groove connection is formed by a groove located in said other of said pair of arms and a tongue projecting upwardly from the top portion of the associated inverted bucket tappet.

6. The valve train mechanism of claim 1 wherein said other of said arms includes a third spherical joint and said crosshead is designed so that the contact point between said second spherical joint and said crosshead is located below a line joining the centers of said first spherical joint and said third spherical joint.

7. A valve train mechanism for an internal combustion engine having a cylinder head fixedly mounted on an engine block provided with one or more cylinders each of which has a piston reciprocally supported therein along the axial center line of the associated cylinder, a combustion chamber in each of said cylinders of said engine and being defined by a recess in said cylinder head and the top of said piston, said valve train mechanism including a pair of intake valves and a pair of exhaust valves, each said pair of intake valves and each of said pair of exhaust valves being inclined outwardly from said combustion chamber at substantially equi-angular orientation relative to said axial center line and having an inverted bucket tappet mounted on the upper end thereof, a spherical joint provided between each of said inverted bucket tappets and said upper end of the associated valve, a first "T" bridge having a pair of arms disposed to contact the top portions of said inverted bucket tappets of said pair of intake valves, a second "T" bridge having a pair of arms disposed to contact the top portions of said pair of exhaust valves, each of the pair of inverted bucket tappets of same function valves being supported in a tappet guide which causes said pair of inverted bucket tappets to move along an axes inclined towards each other and which lie in a plane extending normal to the rotational axis of the crankshaft of the engine, said first "T" bridge and said second "T" bridge being disposed in spaced parallel planes each of which extends essentially transversal to said rotational axis of said crankshaft, one of said arms of said first "T" bridge and one of said arms of said second "T" bridge contacting the top portion of the associated pair of inverted bucket tappets through a first spherical joint, the other of said arms of said first "T" bridge and the other of said arms of said second "T" bridge contacting the associated pair of inverted bucket tappets through a tongue and groove connection which prevents rotation of the associated "T" bridge about its support axis, a first rocker arm pivoted on a rocker shaft and having one end thereof engaging the center of said first "T" bridge through a second spherical joint, a second rocker arm pivoted on a rocker shaft and having one end thereof engaging the center of said second "T" bridge through a third spherical joint, and a camshaft operatively connected to the other end of each of said first rocker arm and said second rocker arm, the arrangement of said pair of intake valves, said pair of exhaust valves, said inverted bucket tappets, said first, second and third spherical joints, and said first and second "T" bridges being such that sufficient space is provided in the cylinder head to accommodate a combustion ignition device centrally of said valves.

8. A valve train mechanism for an internal combustion engine having a cylinder head fixedly mounted on an engine block provided with one or more cylinders each of which has a piston reciprocally supported therein along the axial center line of the associated cylinder, a hemispherical combustion chamber in each of said cylinders of said engine and being defined by a recess in said cylinder head and the top of said piston, said valve train mechanism including a pair of intake valves and a pair of exhaust valves, each said pair of intake valves and each of said pair of exhaust valves being inclined outwardly from said combustion chamber at substantially equi-angular orientation relative to said axial center line and having an inverted bucket tappet mounted on the upper end thereof, a spherical joint provided between each of said inverted bucket tappets and said upper end of the associated valve, a first "T" bridge having a pair of arms disposed to contact the top portions of said inverted bucket tappets of said pair of intake valves, a second "T" bridge having a pair of arms disposed to contact the top portions of said pair of exhaust valves, each of the pair of inverted bucket tappets of same function valves being supported in a tappet guide which causes said pair of inverted bucket tappets to move along axes inclined towards each other and which lie in a plane extending normal to the longitudinal centerline of the engine, said first "T" bridge and said second "T" bridge being disposed in spaced parallel planes each of which extends essentially transversal to said centerline of said engine, one of said arms of said first "T" bridge and one of said arms of said second "T" bridge contacting the top portion of the associated pair of inverted bucket tappets through a first spherical joint, the other of said arms of said first "T" bridge and the other of said arms of said second "T" bridge contacting the associated pair of inverted bucket tappets through a half-ball providing a tongue and groove connection which prevents rotation of the associated "T" bridge about its support axis, a first rocker arm pivoted on a rocker shaft and having one end thereof engaging the center of said first "T" bridge through a second spherical joint, a second rocker arm pivoted on a rocker shaft and having one end thereof engaging the center of said second "T" bridge through a third spherical joint, and a camshaft operatively connected to the other end of each of said first rocker arm and said second rocker arm, the arrangement of said pair of intake valves, said pair of exhaust valves, said inverted bucket tappets, said first, second and third spherical joints, and said first and second "T" bridges being such that sufficient space is provided in the cylinder head to accommodate a fuel injector centrally of said valves.

9. The valve train mechanism of claim 8 wherein said half-ball is integrally formed with a tongue defined by a pair of spaced planar side walls and a flat top wall and said groove is located in the lower end of said other arm of the "T" bridge.

10. A valve train mechanism for opening and closing the cylinders of an internal combustion engine having an engine block with one or more cylinders therein and a piston operatively disposed in each of the cylinders to define one end portion of a respective combustion chamber therein, a cylinder head operatively disposed on said engine block and having a curved recess therein aligned with said cylinder to define a respective second end portion of said combustion chamber, first and second air intake valves and first and second exhaust valves, valve seats for each of said valves, each of said valves having an enlarged head portion for operative engagement with an associated one of said valve seats and having an elongated stem portion extending from said head portion through a stem opening in said cylinder head, each of said stem portions defining an axis and each being inclined so as to diverge away from the axis of any other of said stem portions, an inverted bucket tappet for each of said valves, a swivel joint provided between each of the inverted bucket tappets and the top of the associated stem portion, a "T" bridge having a pair of opposed arms disposed to contact the top portions of a pair of inverted bucket tappets of a pair of same function valves, each of said pair of inverted bucket tappets of said pair of same function valves being supported in a tappet guide which causes said pair of inverted bucket tappets to move along axes which are inclined towards each other and lie in a plane extending normal to the longitudinal centerline of the engine, said "T" bridge being disposed to move in a plane essentially transversal to said centerline of said engine, one of said arms of said "T" bridge contacting said top portion of one of said pair of inverted bucket tappets through a first spherical joint, the other of said arms of said "T" bridge including a tongue and groove connection for contacting the other of said pair of inverted bucket tappets so as to prevent rotation of said "T" bridge about its support axis, a rocker arm pivoted on a rocker shaft and having one end thereof engaging the center of said "T" bridge through a second spherical joint, and a camshaft operatively connected to the other end of said rocker arm, the arrangement of said intake valves, said exhaust valves, said inverted bucket tappets, said first and second spherical joints, and said "T" bridge being such that sufficient space is provided in the cylinder head to accommodate a combustion initiation device centrally of said valves.

11. The valve train mechanism of claim 10 wherein said tongue and groove connection has its major axis located in a plane which is perpendicular to said support axis of said "T" bridge.

12. The valve train mechanism of claim 10 wherein said tongue and groove connection has its major axis located in a plane that is angled relative to said support axis of said "T" bridge.

* * * * *